US006181295B1

(12) United States Patent
Sharaiha et al.

(10) Patent No.: US 6,181,295 B1
(45) Date of Patent: Jan. 30, 2001

(54) HELIX ANTENNA WITH A BUILT-IN BROADBAND POWER SUPPLY, AND MANUFACTURING METHODS THEREFOR

(75) Inventors: Ala Sharaiha, Rennes; Jean-Marc Toureilles, Lorient; Claude Terret, Rennes; Jean-Pierre Blot, la Turbie, all of (FR)

(73) Assignee: France Telecom, Paris (FR)

( * ) Notice: Under 35 U.S.C. 154(b), the term of this patent shall be extended for 0 days.

(21) Appl. No.: 09/142,985

(22) PCT Filed: Mar. 13, 1997

(86) PCT No.: PCT/FR97/00455

§ 371 Date: Jan. 25, 1999

§ 102(e) Date: Jan. 25, 1999

(87) PCT Pub. No.: WO97/35356

PCT Pub. Date: Sep. 25, 1997

(30) Foreign Application Priority Data

Mar. 19, 1996 (FR) ..... 96 03698

(51) Int. Cl.[7] ..... H01Q 1/36
(52) U.S. Cl. ..... 343/895
(58) Field of Search ..... 343/895, 853, 343/860; 333/17.3, 32, 109, 116

(56) References Cited

U.S. PATENT DOCUMENTS

| | | | | |
|---|---|---|---|---|
| 4,011,528 | | 3/1977 | Podell et al. | 333/10 |
| 5,134,422 | * | 7/1992 | Auriol | 343/895 |
| 5,235,296 | | 8/1993 | Saka | 333/109 |
| 5,541,617 | * | 7/1996 | Connolly et al. | 343/895 |
| 5,828,348 | * | 10/1998 | Tassoudji et al. | 343/895 |
| 5,986,616 | * | 11/1999 | Edvardsson | 343/895 |

FOREIGN PATENT DOCUMENTS

| | | |
|---|---|---|
| 27 08 241 B1 | 2/1978 | (DE) . |
| 0 427 654 A1 | 5/1991 | (EP) . |
| WO 92 05602 | 4/1992 | (WO) . |

OTHER PUBLICATIONS

Shumaker et al., Printed half–wave length quadrifilar helix antenna for GPS Marine applications, Electronics Letters, vol. 32, No. 3, Feb. 1, 1996.

Bricker, Jr., A Shaped Bean Antenna for Satellite Data Communication, AP–S International Symposium, 1976.

* cited by examiner

*Primary Examiner*—Tan Ho
(74) *Attorney, Agent, or Firm*—Kinney & Lange, P.A.

(57) ABSTRACT

A resonant helix antenna comprising at least one helix formed by at least two radiating strands (111 to 114) printed on a substrate. This antenna comprises a miniaturised structure for the wideband supply of the radiating strands that is printed on the substrate and comprises at least one hybrid coupler made out of semi-localised elements so as to reduce the dimensions thereof. In the case of a quadrifilar helix, formed by four radiating strands, the supply structure comprises three hybrid couplers, for example in the form of a first 180° hybrid coupler (12) associating a supply input and/or output (17) of the antenna with two intermediate outputs and/or inputs (18, 19) phase-shifted by 180° and two 90° hybrid couplers (13, 14) each associating one of the intermediate outputs and/or inputs of the hybrid coupler with one of the ends of two of the radiating strands.

11 Claims, 6 Drawing Sheets

HELIX ANTENNA WITH A BUILT-IN BROADBAND POWER SUPPLY, AND MANUFACTURING METHODS THEREFOR

BACKGROUND OF THE INVENTION

The field of the invention is that of wide passband antennas with hemispherical or quasi-hemispherical radiation patterns. More specifically, the invention relates to resonant helix antennas and especially to the power supply for said antennas.

The antenna of the invention can find application especially in mobile satellite communications between users in fixed positions and moving bodies of all kinds for example, aeronautical, maritime or land-based bodies. In this field, several satellite communication systems are being implemented or are currently being developed (these include, for example, the INMARSAT, INMARSAT-M, GLOBALSTAR, and other systems). These antennas are also valuable in the deployment of personal communications systems (PCS) using geostationary satellites.

For all these systems, which provide for links with geostationary satellites, the very great difference in incidence between the signals received or transmitted requires that the antenna should have a radiation pattern with hemispherical coverage. Furthermore, the polarisation has to be circular with a ratio of ellipticity of more than 5 dB in the useful band.

More generally, the invention can be applied in all systems requiring the use of a wide band, a radiation pattern with hemispherical coverage, circular polarisation and a good ratio of ellipticity.

In the above-mentioned fields of application, the antennas must have the above-mentioned characteristics either in a very wide passband in the range of 10% or in two neighbouring sub-bands respectively corresponding to reception and transmission.

The patent FR-89 14952 filed on behalf of the present Applicant has already described a known type of antenna particularly suited to such applications.

This antenna, called a resonant quadrifilar helix (RQH) antenna has characteristics very close to the criteria laid down in a frequency band generally limited to 5% owing to problems of impedance matching. Wider band operation is possible by using dual-layer RQH antennas. These antennas are formed by the concentric "nesting" of two electromagnetically coupled coaxial resonant quadrifilar helices.

A quadrifilar antenna is formed by four radiating strands. An exemplary embodiment is described in detail in A. Sharaiha and C. Terret, "Analysis of quadrifilar resonant helical antenna for mobile communications", IEEE—Proceedings H, Vol. 140, No. 4, August 1993.

In this structure, the radiating strands are imprinted on a thin dielectric substrate and then wound on a cylindrical medium that is radio electrically transparent. The four strands of the helix are open or short-circuited at one end and electrically connected at the other end with conductive segments positioned on the base of the lower part of the supporting cylinder. The four strands of the helix are therefore excited through these conductive segments.

This antenna conventionally requires a supply circuit that excites the different antenna strands by signals having the same amplitude in phase quadrature. There are several known techniques used to obtain a supply circuit of this kind.

In the above-mentioned document "Analysis of quadrifilar resonant helical antenna for mobile communications", this function is fulfilled by means of a structure using couplers (3 dB, −90°) and a hybrid ring. This assembly is implanted on a printed circuit placed at the base of the antenna.

This technique has the advantage of being relatively simple to make and implement. By contrast, it leads to a non-negligible space requirement as compared with the antenna (which for example may have a size of about ten centimetres). This drawback makes this approach incompatible with many applications, especially when maximum miniaturisation is required.

According to a second technique described in J. L. Wong and H. E. King, "UHF satellite array nulls adjacent signals" (Microwaves & RF, March 1984), each bifilar helix may be supplied by a "folded balun" type of coaxial symmetrizer. The two bifilars helices are then excited in phase quadrature by means of a hybrid coupler.

The advantage of this method is that it requires the use of only one external hybrid element. By contrast, the symmetrizer/adapter assembly used for this type of antenna (made for example out of a coaxial section whose core and sheath form a dipole) is complex and bulky.

Furthermore, this type of assembly has the drawback of forming a sort of passband filter with a band that is still excessively narrow.

A third, more complex technique is described in C. C. Kilgus, "Resonant quadrifilar helix" (Microwave Journal, December 1970). The coaxial supply line is split at its end to form a symmetrizer. The phase quadrature is provided by adjusting the length of the strand.

This technique is used to eliminate hybrid couplers. However, it has the drawback of requiring a delicate adjustment of the length of the strand. Furthermore, the antenna is no longer symmetrical and the structure will be more complex. Besides, this method remains specifically reserved for systems using a narrow working band.

SUMMARY OF THE INVENTION

The invention is aimed in particular at overcoming these different drawbacks of the prior art.

More specifically, an aim of the invention is to provide an antenna and its system of supply (hereinafter the term "antenna" covers the antenna proper and its system of supply) having a very wide operating frequency band, for example greater than 10%.

Another aim of the invention is to provide an antenna of this kind with a low cost price that is easy to manufacture on an industrial scale. In particular, the invention is aimed at providing an antenna of this kind that can be manufactured in a very small number of successive operations.

Another aim of the invention is to provide an antenna of this kind that does not require specific and complex setting operations.

Yet another aim of the invention is to provide an antenna of this kind (and especially the supply system of such an antenna) taking up little space as compared with known devices.

The invention is also aimed at providing an antenna of this kind, achieving an equal-amplitude excitation of the four strands and a precise phase quadrature relationship and hence high quality circular polarisation in both sub-bands.

These aims as well as others that shall appear hereinafter are achieved according to the invention by means of a resonant helix antenna comprising at least one helix formed by at least two radiating strands printed on a substrate, comprising a miniaturised structure, for the wideband supply of said radiating strands, that is printed on said substrate and comprises at least one hybrid coupler made out of semi-localised (or "non uniformly spaced") elements so as to reduce the dimensions thereof.

The making of the antenna strands and of the supply structure in the form of printed elements enables the the antenna, its supply structure and the duplexer to be made in only one operation without any specific connection means and in a particularly small format.

The use of hybrid couplers made out of semi-localised elements can be used to obtain all the desired features, and especially low space requirements as compared with systems based on the use of conventional lines.

The invention can be applied to all types of helix antennas. According to a preferred embodiment, said helix is a quadrifilar helix, formed by four radiating strands supplied by a supply structure comprising three hybrid couplers.

Advantageously, in the last-named case, said supply structure comprises a first 180° hybrid coupler associating a supply input and/or output of said antenna with two intermediate outputs and/or inputs phase-shifted by 180° and two 90° hybrid couplers each associating one of said intermediate outputs and/or inputs of said hybrid coupler with one of the ends of two of said radiating strands.

According to an advantageous embodiment of the invention, said antenna is mounted on a support having a first part and a second part that are distinct, with different values of permittivity, said first part beating said radiating strands and said second part bearing said supply structure.

Preferably, said first part bearing the antenna strands has a permittivity greater than 1.

It is thus possible to further reduce the amount of space taken up by the antenna.

An antenna of this kind as described here above may be used alone or in an array of antennas.

The invention also relates to the manufacture of said antennas. This manufacture is particularly simplified as compared with the prior art techniques.

In a first method of manufacture of a resonant helix antenna, the following steps are planned:

the printing, on a plane substrate, of at least two radiating antennas designed to form a helix and of an independent, miniaturised structure for the wideband supply of said radiating strands comprising at least one hybrid coupler made out of semi-localised elements so as to reduce the dimensions thereof;

the winding of said substrate around a cylindrical support.

In a second method of manufacture of a resonant helix antenna that is even more simple to implement, the following steps are performed:

the obtaining of a cylindrical support bearing a substrate;

the printing, on said substrate, of at least two radiating antennas designed to form a helix and an independent, miniaturised structure for the wideband supply of said radiating strands comprising at least one hybrid coupler made out of semi-localised elements so as to reduce the dimensions thereof.

BRIEF DESCRIPTION OF THE DRAWINGS

Other features and advantages of the invention shall appear from the following description of a preferred embodiment of the invention given as a simple and non-restricted example, and from the appended figures wherein:

FIG. 8A shows a standard coupler with distributed elements;

FIG. 8B shows a corresponding view using PI cells;

FIG. 8C shows a corresponding microstrip line coupler;

FIG. 9A shows a 180° hybrid ring;

FIG. 9B shows a corresponding microstrip line coupler.

The invention therefore relates to an antenna with a wideband supply system made according to a simple, low-cost manufacturing technique.

As indicated here above, the invention can be applied to any type of helix antenna. The preferred embodiment described here above relates to a quadrifilar helix antenna.

DETAILED DESCRIPTION

Figure 1:
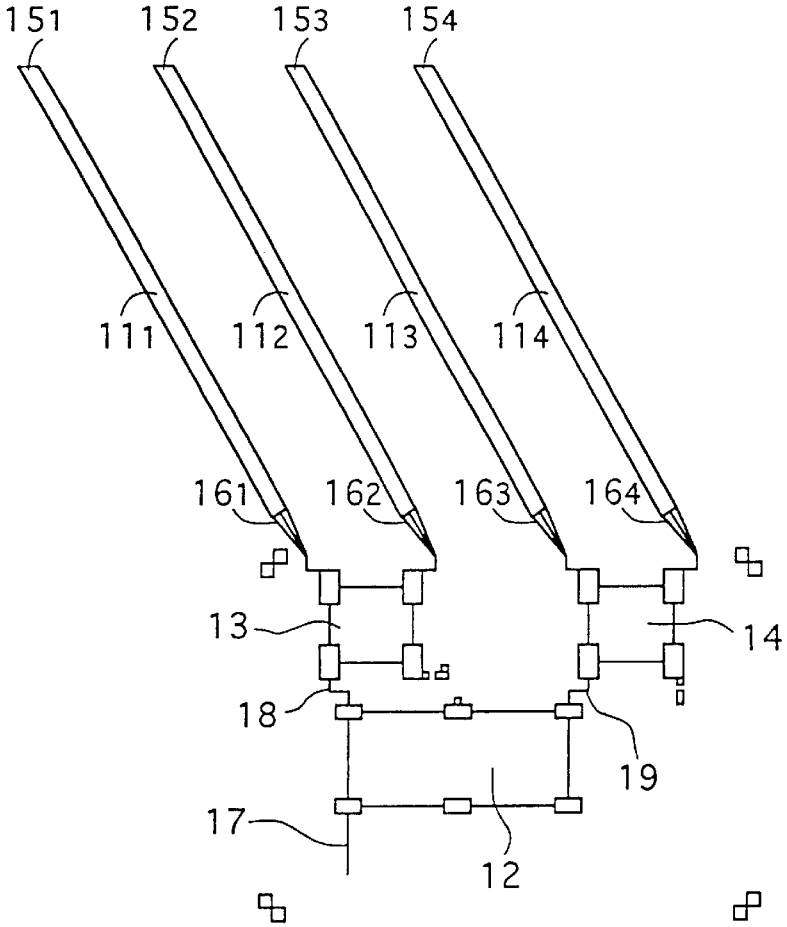
FIG. 1 exemplifies a quadrifilar helix with integrated supply according to the invention, laid out in a flat representation.

According to the invention, the four strands of the antenna and a supply structure are printed on one and the same substrate. FIG. 1 illustrates the printed elements when the helix is laid out flat.

It comprises first of all, four radiating antenna strands $\mathbf{11}_1$ to $\mathbf{11}_4$.

One mode of determining the characteristics of these strands is given for example in the patent FR-89 14952 already referred to.

The dimensions of the antenna vary as a function of the frequency band and the coverage values required. For example, the dimensions of this antenna may be as follows:

length: 90 mn;

width: 2 mm;

thickness: 35 $\mu$m;

angle of inclination: 54.5°.

They are made for example of copper on a thin dielectric substrate such as kapton ($\in_r \approx 3.8$).

The four strands $\mathbf{11}_1$ to $\mathbf{11}_4$ are preferably open at their upper end $\mathbf{15}_1$ to $\mathbf{15}_4$. They may also be short-circuited. However, the system of the invention is particularly appropriate to the excitation of antennas with strands that are more open and, for equal performance characteristics, possess dimensions that are smaller than those of the short-circuited strand antennas.

The other end $\mathbf{16}_1$ to $\mathbf{16}_4$ of the strands is connected to the feeder lines of the supply circuit.

The supply system is made on the same substrate, in the extension of the antenna. It is formed by three hybrid couplers 12, 13 and 14 designed as being made of semi-localised elements or non uniformly spaced.

The first hybrid coupler 12 is connected firstly to the input (and output respectively depending on the use) 17 of the antenna signal and secondly to the two inputs (and outputs respectively) 18 and 19 of the other two couplers 13 and 14. It is a 180° hybrid coupler.

The hybrid couplers 13 and 14 are two identical 90° couplers. They are connected firstly to the input 18 (and 19 respectively) and secondly to the end of the strands $\mathbf{16}_1$ and $\mathbf{16}_2$ (and $\mathbf{16}_3$ and $\mathbf{16}_4$ respectively).

Thus the four strands are supplied in perfect phase quadrature on a very wide band.

Figure 2:
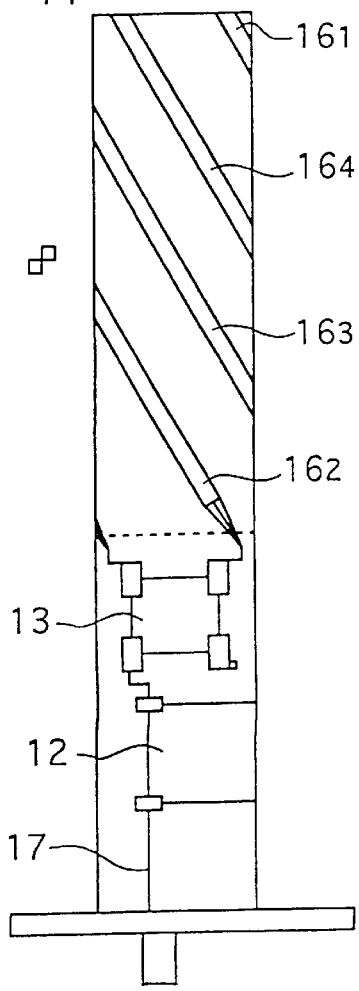
FIG. 2 shows the helix of FIG. 1, wound cylindrically, so as to form an operational helix.

The assembly thus obtained is then wound on a cylindrical support, to obtain the external helix shown in a front view in FIG. 2.

The cylindrical support is a support that is radio electrically transparent, namely it has a permittivity close to 1.

It must be noted that it is easy to further reduce the height of the assembly by using a support with a permittivity greater than 1 for the part corresponding to the antenna strands.

Figure 3:
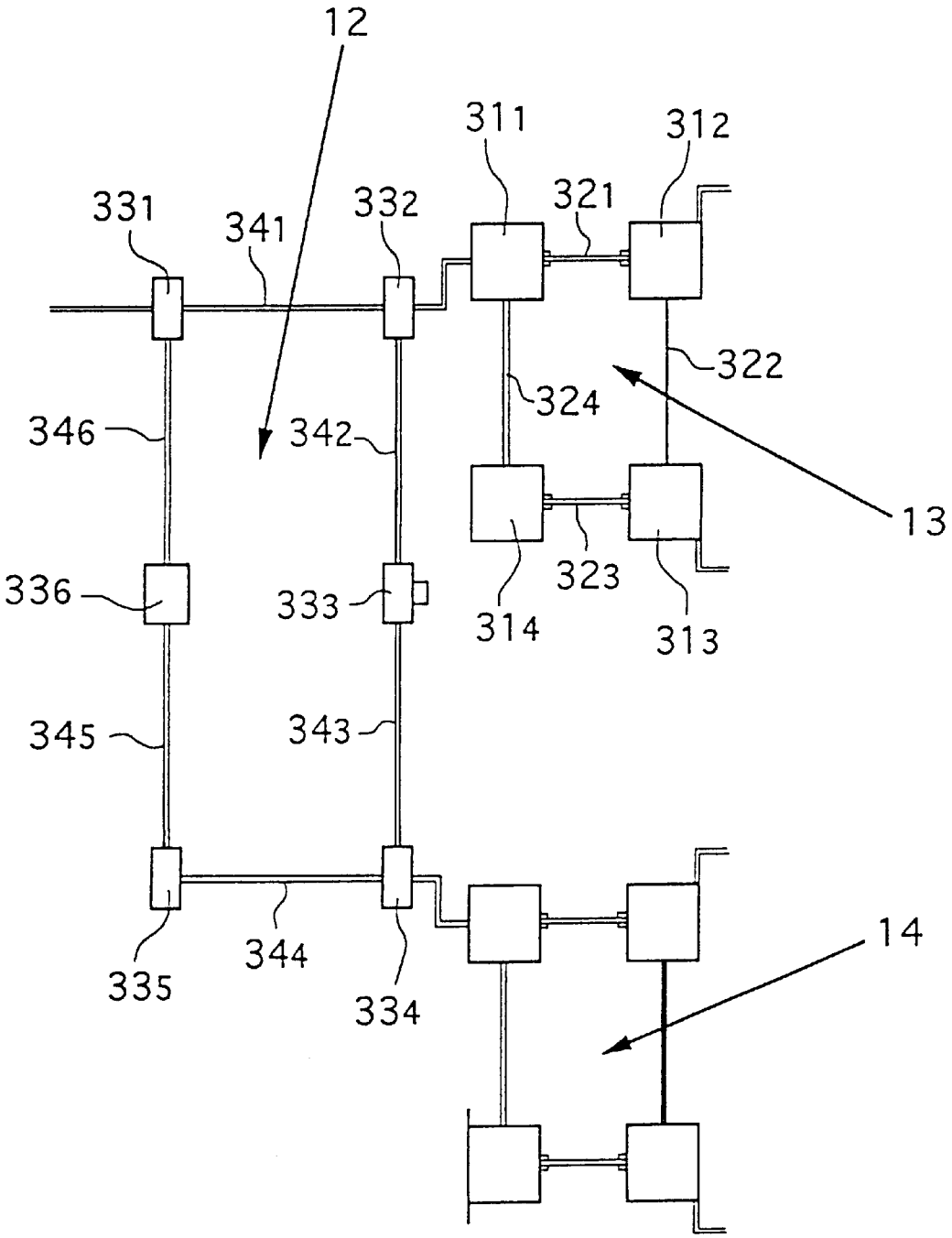
FIG. 3 gives a more detailed view of the supply structure of FIGS. 1 and 2.

FIG. 3 gives a more precise view of the supply structure using semi-localised elements according to the invention, magnified by a factor of 3 with respect to its real size. It comprises two types of printed lines:

lines of small width having an inductive characteristic;

wider lines having a capacitive characteristic.

Thus, the 90° couplers 13 and 14 are each formed by four wide elements $\mathbf{31}_1$ and $\mathbf{31}_4$ connected in pairs of two by four lines of small width $\mathbf{32}_1$ to $\mathbf{32}_4$. The 180° coupler has six wide elements $\mathbf{33}_1$ to 336 connected by six lines of small width 341 to 346.

Figure 8A:
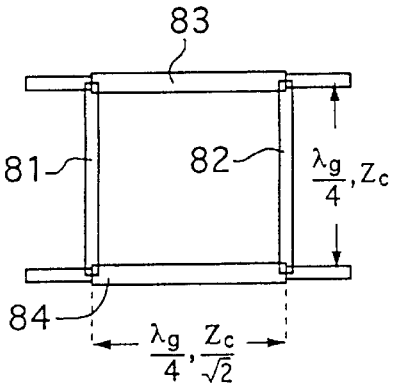
FIGS. 8A to 8C illustrate the design of a −3 dB, 90° coupler according to the invention.
Figure 8B:
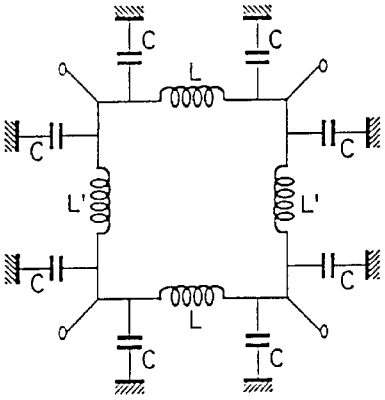
Figure 8C:
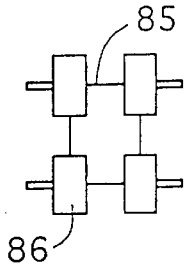

FIGS. 8A and 8C illustrate the design of a −3 dB 90° coupler.

More substantial details can be found if necessary in the thesis by M. Coupez, Université de Bretagne Occidentale, "Etude de structures de déphaseurs potentiellement intégrables à 900 MHz" (Study of phase-shifter structures that can be potentially integrated at 900 MHz), May 1988.

FIG. 8A is the standard drawing of a −3 dB 90° coupler made of distributed elements. It has two line sections 81, 82 with a length λg/4 and a characteristic impedance Zc and two line sections 83, 84 with a length λg/4 and a characteristic impedance Zc/√2.

Each of these two line sections can be replaced by π-shaped cells of localised elements formed by capacitors C and inductors L and L', as illustrated in FIG. 8B.

By using the inductive properties (lines of small width 85) and capacitive properties (wider lines 86) of the microstrip lines, it is then possible to again transform the coupler made of distributed elements as shown in FIG. 8C.

Figure 9A:
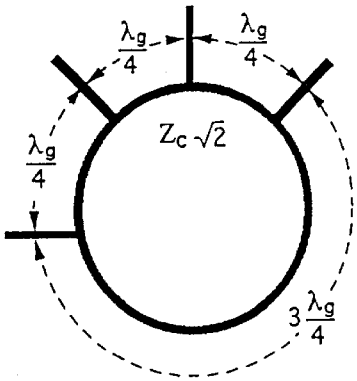
FIGS. 9A and 9B illustrate the design of a −3 dB 180° coupler.
Figure 9B:
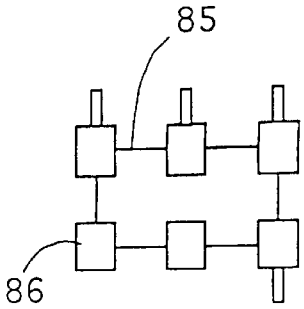

The same procedure is used to convert the standard structure of a −3 dB, 180° hybrid ring shown in FIG. 9A into a coupler with semi-localised elements illustrated in FIG. 9B.

An antenna of this kind especially has the following advantages:

the antenna has open strands, hence the impedance of each strand can easily be matched to 50 Ω for an antenna having the desired properties (hemispherical coverage and low reverse polarisation);

the supply structure using hybrids is a wideband structure that is perfectly balanced:
in amplitude (identical for each strand); and
in phase (0°; ±90°; ±180°; ±270°);

the dimensions of the supply device are smaller than those of known systems (a gain of 50% may be obtained). Indeed, it can easily be seen that each semi-localised element has a size far smaller than that of the line that replaces it (which is generally a size that is a multiple of λ/4);

the antenna has high strand-to-strand insulation.

By way of an indication, the following are the results of measurements obtained with a particular embodiment, designed for communications with equipment and communications at close range.

The dimensions of the assembly formed by the antenna and the integrated supply are as follows:

diameter: 24 mm;

height: 110 mm:

total weight: 70 g.

The radioelectrical characteristics measured are:

transmission: 2.17–2.2 GHz;

reception: 1.98–2.01 GHz;

polarisation: right circular;

ellipticity: <5 dB for θ<90°

<2 dB for θ<75°;

defect of omnidirectionality: ±0.6 dB on the horizon.

Figure 4:
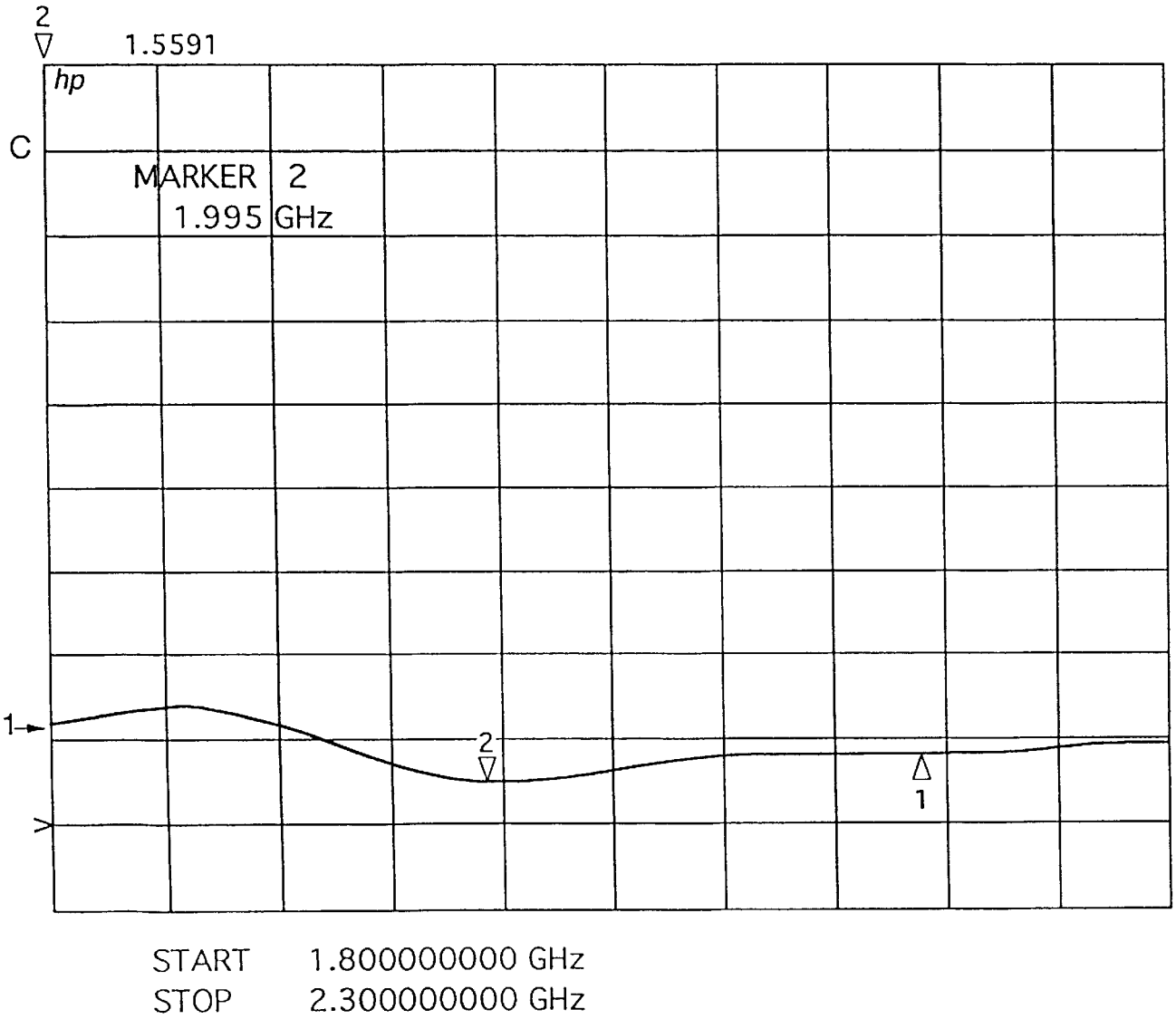
FIG. 4 illustrates the standing wave ratio (SWR) of a particular embodiment of the antenna of FIGS. 1 and 2.

FIG. 4 shows the standing wave ratio (SWR) at the input of the antenna as a function of the frequency. It can be seen that an SWR of less than 2 is obtained for each antenna in a 400 MHz band.

Figure 5:
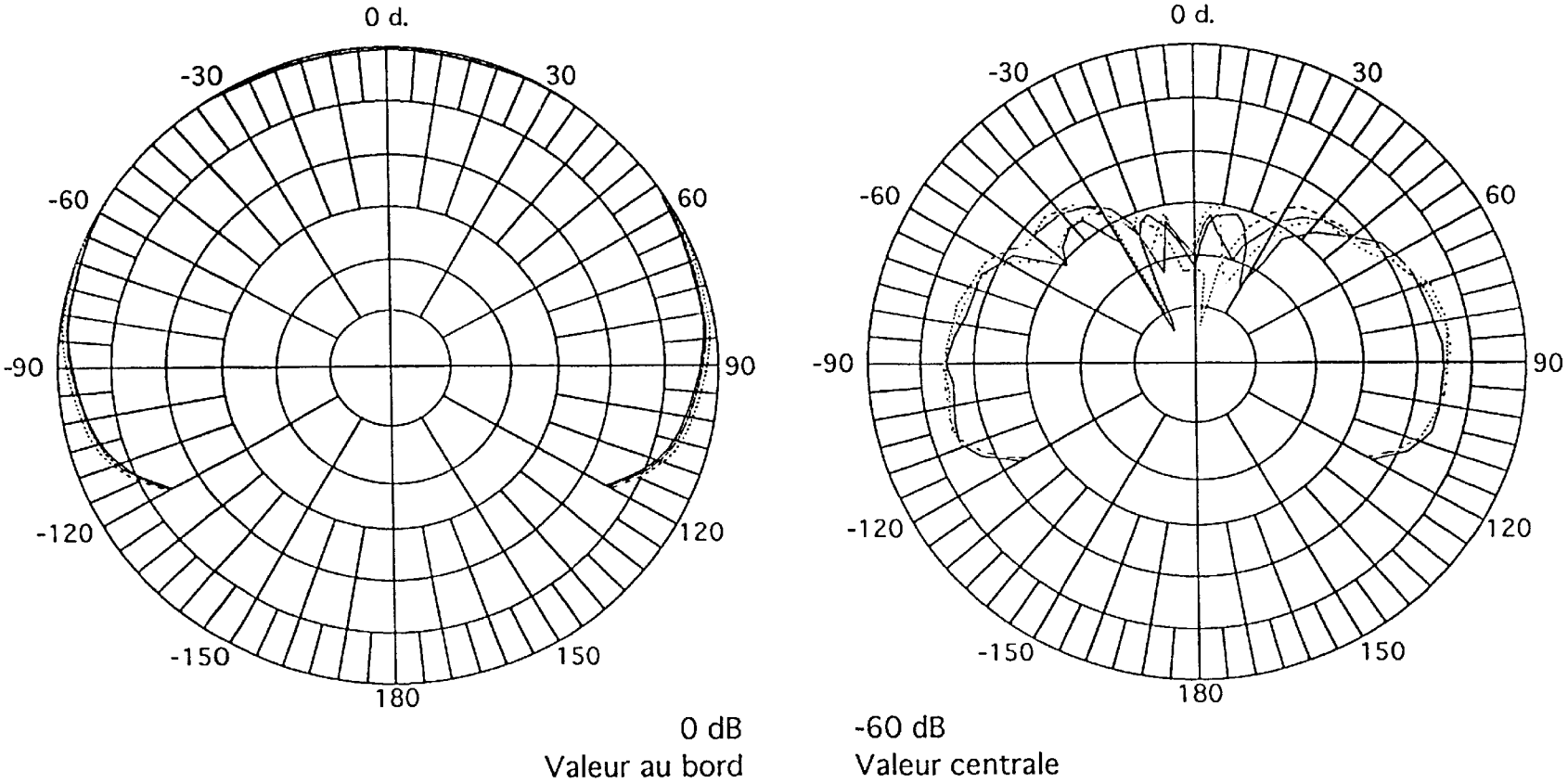
FIGS. 5 and 6 show radiation patterns, measured in right circular polarisation and left circular polarisation, of the same embodiment, respectively at the frequencies 1.98 GHz and 2.2 GHz.
Figure 6:
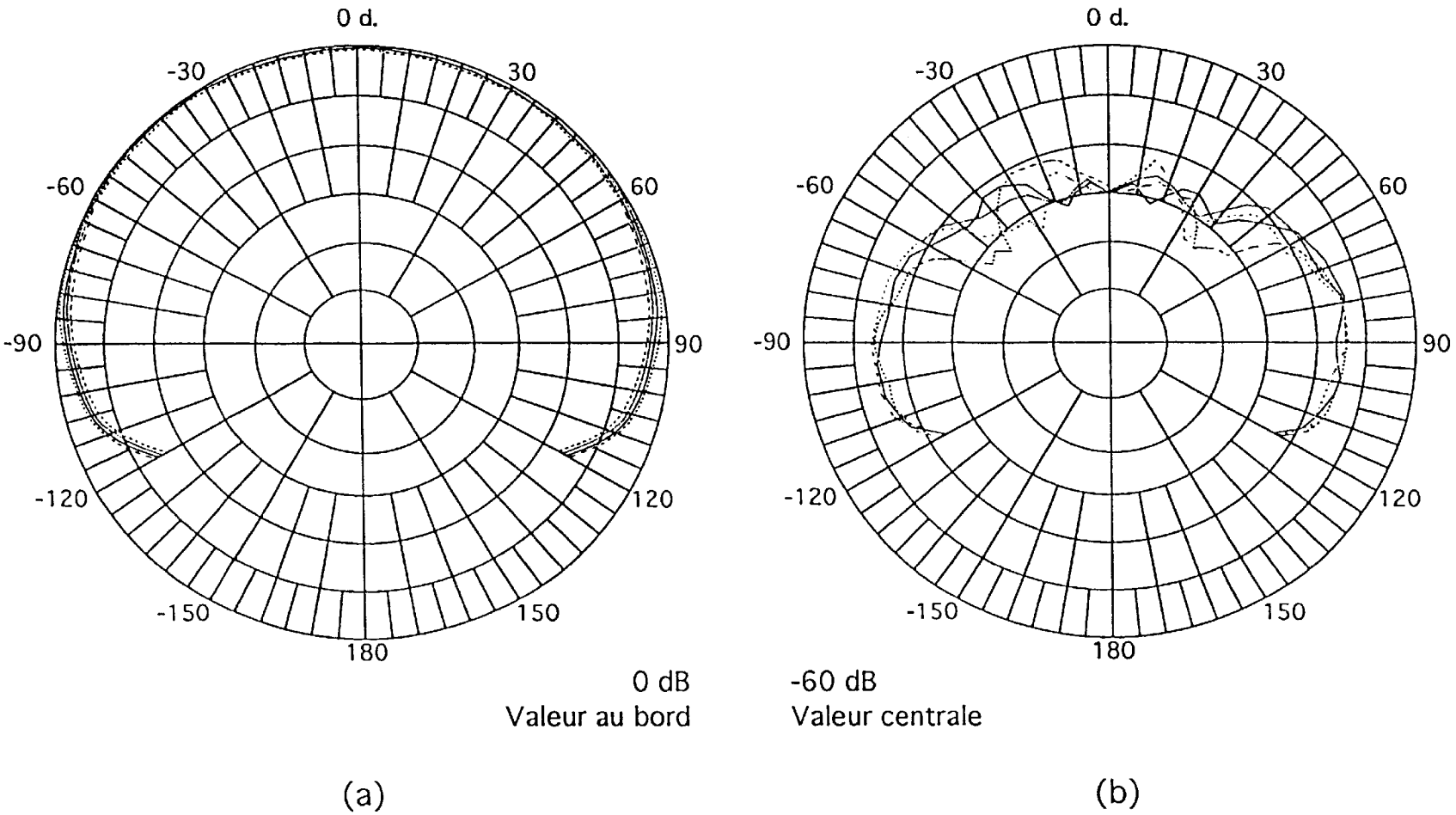

FIGS. 5 and 6 pertain to the radiation patterns measured in right circular polarisation (a) and in left circular polarisation (b) respectively at the frequencies 1.98 GHz (FIG. 5) and 2.2 GHz (FIG. 6).

It can be seen that the following are obtained:

a mean aperture at −3 dB that is quasi-hemispherical and greater than 180°;

a rejection of the reversed polarisation greater than −15 dB throughout the coverage.

Figure 7:
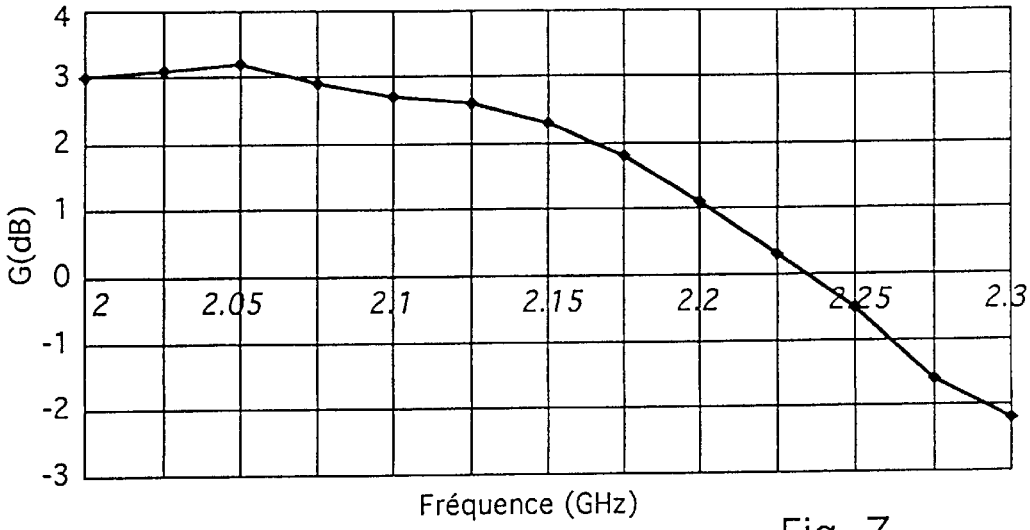
FIG. 7 shows the gain measured in the direction of the maximum radiation of this same antenna, as a function of the frequency

FIG. 7 shows the gain measured in the direction of the maximum radiation as a function of frequency. It can be seen that the antenna can be used in a very wide band (greater than 12%) with high performance characteristics (gain, rejection of the reverse polarisation, omnidirectionality etc.).

This type of supply sometimes makes it possible, through the insulation related to the hybrid couplers, to make the antennas work in a wide band.

An antenna according to the invention can be made in various ways.

Thus, according to a first embodiment, it can be printed flat as shown in FIG. 1. It is then wound on a support to form the antenna (FIG. 2).

According to another embodiment that is even speedier, the substrate designed to receive the printed elements may be made directly in its definitive cylindrical shape. In this case, the printing of the strands and of the supply structure is done directly on the cylinder.

Furthermore, it must be noted that although it can be used as a unit, the antenna of the invention advantageously lends itself to the making of antenna arrays.

It is also possible to mount two antennas of this type coaxially and concentrically, according to the technique described in detail in the patent application filed by the present Applicant on the same date, and entitled "Helix antenna with integrated duplexing means and corresponding methods of manufacture".

What is claimed is:

1. A resonant helix antenna comprising at least one helix formed by at least two radiating strands printed on a substrate, characterised in that said antenna comprises a miniturised structure for the wideband supply of said radiating strands, that is printed on said substrate and comprises at least one hybrid coupler made out of semi-localised elements, said semi-localised elements are designed according to following steps:

designing said coupler with conventional distributed stripline elements, each of them having at least a λ/4 length:

turning each of said distributed stripline element into lumped elements, each of them being a π cell made of one capacitance C and two inductances L, L';

turning each of said capacitances and inductances into semi-localised elements, each of said inductances being turned into a reduced width line and each of capacitance into a larger width line, each of said line being smaller than $\lambda/4$;

so that the space requirement of said supply structure is smaller than $\lambda/4$, $\lambda$ being the maximum wavelength of operation of said antenna.

2. An antenna according to claim 1, characterised in that said helix is a quadrifilar helix, formed by four radiating strands supplied by a supply structure comprising three hybrid couplers.

3. An antenna according to claim 2, characterised in that said supply structure comprises a first 180° hybrid coupler associating a supply input and/or output of said antenna with two intermediate outputs and/or inputs phase-shifted by 180° and two 90° hybrid couplers each associating one of said intermediate outputs and/or inputs of said hybrid coupler with one of the ends of two of said radiating strands.

4. A resonant helix antenna comprising at least one helix formed by at least two radiating strands printed on a substrate, characterised in that said antenna comprises a miniaturised structure, for the wideband supply of said radiating strands, that is printed on said substrate and comprises at least one hybrid coupler made out of semi-localised elements, so that the space requirement of said supply structure is smaller than $\lambda/4$, $\lambda$ being the maximum wavelength of operation of said antenna, mounted on a support having a first part and a second part that are distinct with different values of permittivity, said first part bearing said radiating strands and said second part bearing said supply structure.

5. An antenna according to claim 4, characterised in that said first part bearing said radiating strands has a permittivity greater than the permittivity of said second part.

6. A resonant helix antenna according to claim 5, wherein said semi-localised elements are designed according to following steps:

designing said coupler with conventional distributed stripline elements, each of them having at least a $\lambda/4$ length;

turning each of said distributed stripline element into lumped elements, each of them being a $\pi$ cell made of one capacitance C and two inductances L, L';

turning each of said capacitances and inductances into semi-localised elements, each of said inductances being turned into a reduced width line and each of capacitance into a larger width line, each of said line being smaller than $\lambda/4$.

7. A resonant helix antenna according to claim 4, characterised in that said helix is a quadrifilar helix, formed by four radiating strands supplied by a supply structure comprising three hybrid couplers.

8. An antenna according to claim 7, characterised in that said supply structure comprises a first 180° and two 90° hybrid couplers each associating one of said intermediate outputs and/or inputs of said hybrid coupler with one of the ends of two of said radiating strands.

9. A resonant helix antenna according to claim 4, wherein said semi-localised elements are designed according to following steps:

designing said coupler with conventional distributed stripline elements, each of them having at least a $\lambda/4$ length;

turning each of said distributed stripline element into lumped elements, each of them being a $\pi$ cell made of one capacitance C and two inductances L, L';

turning each of said capacitances and inductances into semi-localised elements, each of said inductances being turned into a reduced width line and each of capacitance into a larger width line, each of said line being smaller than $\lambda/4$.

10. A method for the manufacture of a resonant helix antenna with miniaturised supply, characterised in that it comprises the following steps:

the printing, on a plane substrate, of at least two radiating strands designed to form a helix and of an independent, miniaturised structure for the wideband supply of said radiating strands comprising at least one hybrid coupler made out of semi-localised elements, said semi-localised elements are designed according to following steps:

designing said coupler with conventional distributed stripline elements, each of them having at least a $\lambda/4$ length;

turning each of said distributed stripline element into lumped elements, each of them being a $\pi$ cell made of one capacitance C and two inductances L, L';

turning each of said capacitances and inductances into semi-localised elements, each of said inductances being turned into a reduced width line and each of capacitance into a larger width line, each of said line being smaller than $\lambda/4$;

so that the space requirement of said supply structure is smaller than $\lambda/4$, $\lambda$ being the maximum wavelength of operation of said antenna;

the winding of said substrate around a cylindrical support.

11. A method for the manufacture of a resonant helix antenna with miniaturised supply, characterised in that said method comprises the following steps:

the obtaining of a cylindrical support bearing a substrate;

the printing, on said substrate, of at least two radiating antennas designed to form a helix and an independent, miniaturised structure for the wideband supply of said radiating strands comprising at least one hybrid coupler made out of semi-localised elements, said semi-localised elements are designed according to following steps:

designing said coupler with conventional distributed stripline elements, each of them having at least a $\lambda/4$ length:

turning each of said distributed stripline element into lumped elements, each of them being a $\pi$ cell made of one capacitance C and two inductances L, L';

turning each of said capacitances and inductances into semi-localised elements, each of said inductances being turned into a reduced width line and each of capacitance into a larger width line, each of said line being smaller than $\lambda/4$;

so that the space requirement of said supply structure is smaller than $\lambda/4$, $\lambda$ being the maximum wavelength of operation of said antenna.

* * * * *